US008117775B2

(12) United States Patent
Hedditch

(10) Patent No.: US 8,117,775 B2
(45) Date of Patent: Feb. 21, 2012

(54) SIGN ATTACHMENT DEVICE

(76) Inventor: Tracy Hedditch, Kilmore (AU)

( * ) Notice: Subject to any disclaimer, the term of this patent is extended or adjusted under 35 U.S.C. 154(b) by 0 days.

(21) Appl. No.: 12/506,608

(22) Filed: Jul. 21, 2009

(65) Prior Publication Data

US 2010/0050490 A1 Mar. 4, 2010

Related U.S. Application Data

(63) Continuation-in-part of application No. 12/441,001, filed as application No. PCT/AU2007/001349 on Sep. 13, 2007.

(30) Foreign Application Priority Data

Sep. 13, 2006 (AU) ..... 2006905059
Mar. 11, 2009 (AU) ..... 2009901038

(51) Int. Cl.
*G09F 15/00* (2006.01)

(52) U.S. Cl. ..... 40/607.14; 40/607.11

(58) Field of Classification Search ..... 40/607.13, 40/607.14, 607.12, 607.11, 611.12; 248/218.4, 248/219.4, 451
See application file for complete search history.

(56) References Cited

U.S. PATENT DOCUMENTS

| | | | | |
|---|---|---|---|---|
| 580,806 | A * | 4/1897 | Scranton | 40/606.15 |
| 1,790,598 | A * | 1/1931 | Schwartz et al. | 40/611.04 |
| 4,548,377 | A * | 10/1985 | Huel | 248/219.1 |
| 6,293,035 | B1 * | 9/2001 | LaPointe | 40/607.12 |
| 6,676,100 | B2 * | 1/2004 | Hsu | 248/452 |
| 2003/0213153 | A1 * | 11/2003 | Kim | 40/607.14 |
| 2007/0256341 | A1 * | 11/2007 | McLaughlin | 40/607.13 |

* cited by examiner

*Primary Examiner* — Joanne Silbermann
*Assistant Examiner* — Kristina Staley

(57) ABSTRACT

A sign attachment device including a body portion for attaching a sign and an attachment portion whereby, the sign attachment device provides a means for enabling a sign to be secured to at least one support member.

The body portion preferably has provided two parallel side walls which are adapted to be spaced apart by a prescribed distance to receive and hold the edge of a sign therebetween. The side wails preferably have provided at least one aperture which Is adapted to receive a securing member therethrough In order to secure a sign to the attachment device. It Is preferred that the side walls have at least one crest portion which Is adapted to accommodate the presence of a prong member positioned between said side walls. The attachment portion consists of two side portions divided by a living hinge so that the device can be attached to any shaped support.

12 Claims, 5 Drawing Sheets

SIGN ATTACHMENT DEVICE

CROSS REFERENCE TO RELATED APPLICATIONS

This application is a Continuation-In-Part of co-pending application Ser. No. 12/441,001, filed on Mar. 12, 2009, and for which priority is claimed under 35 U.S.C. §120, which is the National Stage of International Application No. PCT/AU2007/001349 filed on Sep. 13, 2007, and claims priority of Application No. 2006905059 filed in Australia on Sep. 13, 2006; and this application claims priority of Application No. 2009901038 filed in Australia on Mar. 11, 2009 under 35 U.S.C. §119; the entire contents of all are hereby incorporated by reference.

FIELD OF THE INVENTION

The invention relates to the area of signage and accessories and in particular, to a sign attachment device which provides a means for enabling a sign to be secured to at least one support member.

Whilst the invention can be applied to any signage which Is erected using support members and/or stakes which are Inserted into the ground or otherwise positioned, and the style of the device can be modified to suit various support members and/or signage, for convenience sake it shall be described herein as a sign attachment device for securing signs to at least one support member and/or surface.

BACKGROUND TO THE INVENTION

One of the most common materials used to make signs, such as real estate signs, Is a material commonly referred to as flute board or coreflute. This material is characterised by the holes which extend throughout Its core. These signs are commonly installed using support members, such as star pickets which are driven into the ground or wooden posts via self-drilling screws. The signs are usually attached to the star pickets using cable ties, wire or string or the like. However, the installation process using this current method can be fairly tedious and damages the actual sign, as It is difficult to stably secure the sign to the support members.

There have been various devices which have been developed for the installation of these types of signs. These prior art devices involve the use of frame assemblies for holding or hanging a sign board. The frame assemblies are generally specific to the size of the sign and thus, a major disadvantage of the prior art is the further expense Incurred in purchasing frame assemblies to suit each sign's style and dimensions. The prior art falls to provide a sign support/attachment device which enables a user to quickly and easily install any flute board or coreflute sign to a star picket post or fence without damaging the sign.

Accordingly, it is an object of the present invention to provide a sign attachment device which provides a means for enabling signs to be secured to at least one support member.

It is a further object of the Invention to provide a sign attachment device which is easy to install, maintenance free, will not damage the sign and provides a cost-effective solution.

SUMMARY OF THE INVENTION

The present invention provides a sign attachment device including:

a body portion for attaching a sign;

and an attachment portion whereby, the sign attachment device provides a means for enabling a sign to be secured to at least one support member.

The body portion preferably has provided two parallel side walls which are adapted to be spaced apart by a prescribed distance to receive and hold the edge of a sign therebetween. The side wails preferably have provided at least one aperture which Is adapted to receive a securing member therethrough In order to secure a sign to the attachment device. It Is preferred that the side walls have at least one crest portion which Is adapted to accommodate the presence of a prong member positioned between said side walls.

It is further preferred that the body portion of the device preferably has provided a base member. At least one prong member is preferably adapted to be integrally formed with the base member of the body portion and be positioned between the two side walls wherein the prong members can be of different lengths.

In a first aspect, the attachment portion Is preferably adapted to be integrally formed with the inner side wall and/or base member of the body portion of the device. The attachment portion preferably has provided a curved portion which is adapted to be integrally formed with an inner side wall of the body portion.

The attachment portion may preferably have provided at least one reinforcement member which is adapted to be Integrally formed with the curved portion of the attachment portion and the inner side wall of the body portion to provide a means of transferring any wind pressure to the support member/post, The attachment portion preferably has provided at least one aperture which is adapted to receive a securing means therethrough for securing the device to a support member.

In a second aspect, the attachment portion is preferably In the form of a bracket for attachment to a cylindrical support member and/or a support member having a corner and/or a flat support member or surface. The attachment portion preferably has provided at least one side portion, preferably two, which are adapted to be integrally formed with, and positioned perpendicularly to, each other. It is preferred that a first side portion may be Integrally formed with the base member and/or inner side wall or end of a second side portion. It is further preferred that the side portion(s) have provided at least one aperture which is adapted to receive a securing means therethrough. The side portion(s) preferably has/have provided at least one recessed portion for receiving a securing means therein.

In order that the invention may be more readily understood we will describe by way of non-limiting example specific embodiments thereof.

BRIEF DESCRIPTION OF THE DRAWING FIGURES

DETAILED DESCRIPTION OF A PREFERRED EMBODIMENT OF THE INVENTION

Figure 1:
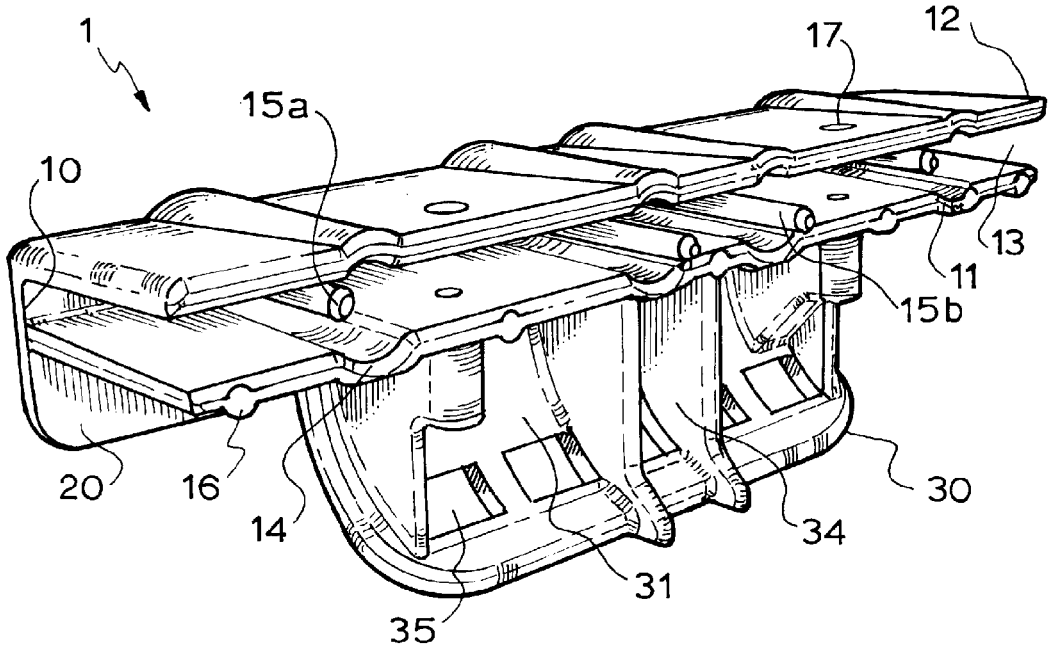
FIG. 1 shows a top perspective view of the sign attachment device according to an embodiment of the invention.
Figure 2:
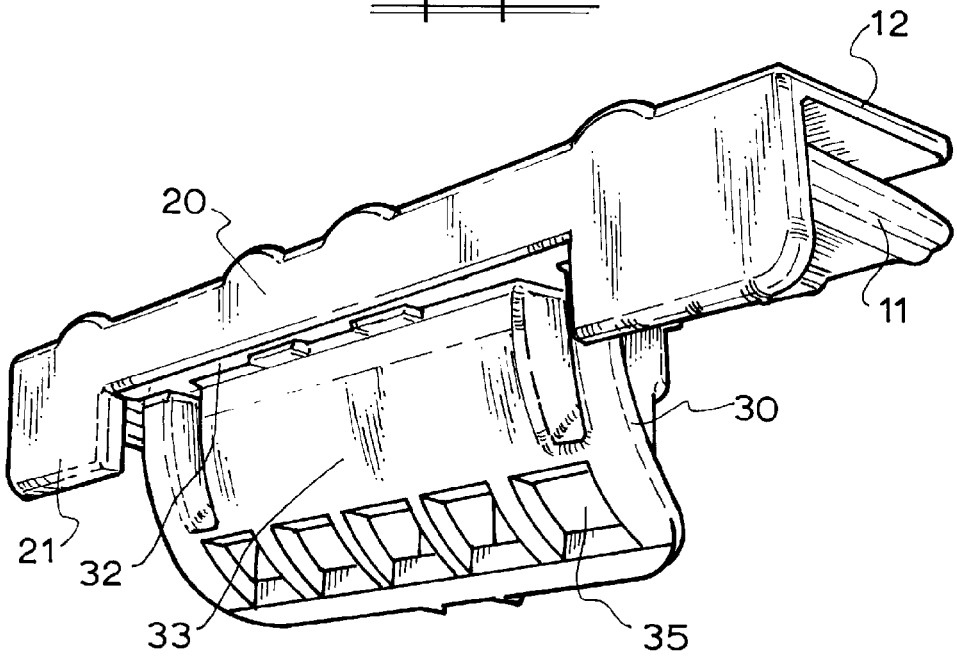
FIG. 2 shows a bottom perspective view of the sign attachment device according to an embodiment of the invention.
Figure 3:
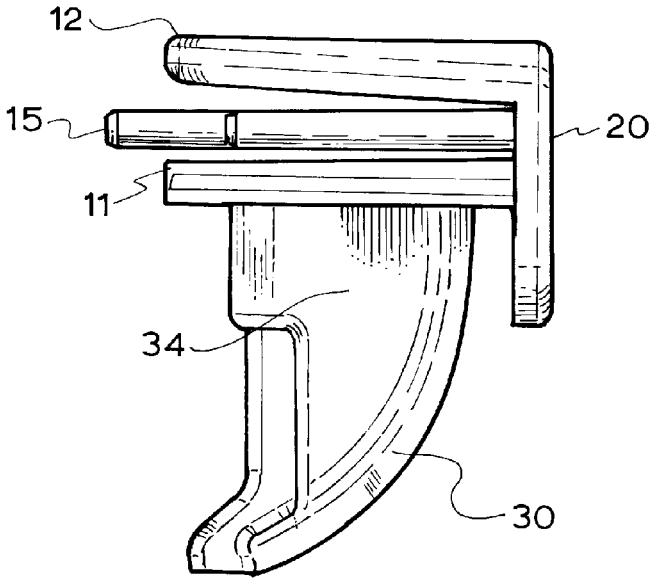
FIG. 3 shows a side view of the sign attachment device according to an embodiment of the invention.
Figure 4:
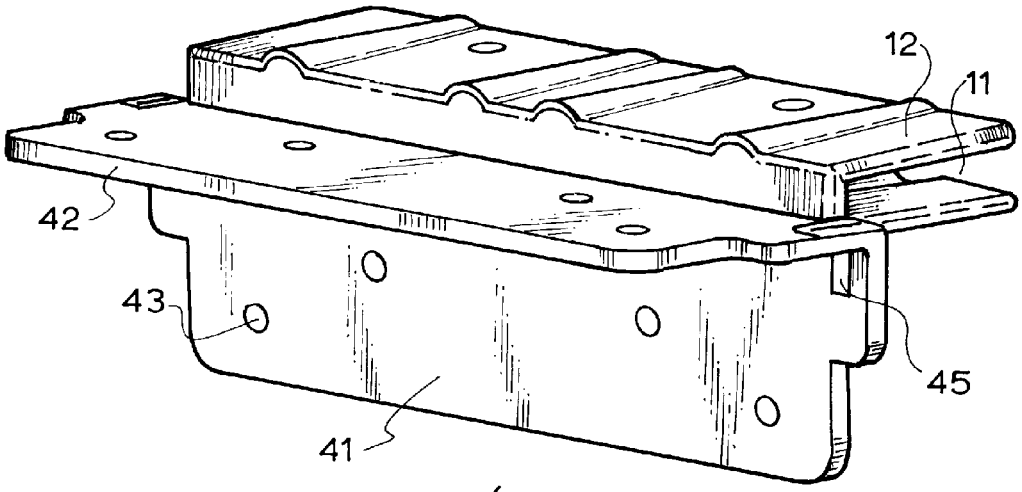
FIG. 4 shows a bottom perspective view of the sign attachment device according to an embodiment of the invention whereby the attachment portion is preferably In the form of a bracket for attachment to a cylindrical support member and/or a support member having a corner and/or a flat support member or surface.

FIGS. 1 to 8 show the sign attachment device according to preferred embodiments of the invention.

In this preferred embodiment, the Invention provides a sign attachment device 1 which provides a means for enabling signs to be secured to at least one support member/surface, (not shown). The device 1 is preferably made of an extruded plastics material, However, it Is envisaged that any other suitable material may also be adopted which meets the requirements of the invention. The material should preferably be able to withstand exposure to the external elements and provide strength and durability to the device to securely hold a sign (not shown) in place. It Is envisaged that the shape, style and dimensions of the sign attachment device 1 may also be varied and modified to suit different sign boards and/or support members to which it Is to be attached.

The sign attachment device 1 preferably has provided a body portion 10 which is adapted to receive and hold an edge of a sign therein. The sign may preferably be any suitable signage Including, but not limited to, real estate signs, shop signs, property or building signs, commercial signs, advertising/billboards or any other suitable type of signage. It is envisaged that the device 1 is preferably used for a sign made of fluteboard or a coreflute material. However, it could also be altered to suit signs made of different materials. The body portion 10 preferably has provided at least one side wall. In a preferred embodiment, the body portion has provided two side walls 11, 12. The side walls 11, 12 are preferably adapted to be integrally formed with a base member 20 of the body portion 10 and are adapted to extend outwardly in a perpendicular direction relative to the base member 20. The side walls 11, 12 are preferably positioned parallel to each other and are preferably positioned so that they are spaced apart from each other by a prescribed distance. The space 13 provided between the two parallel side walls 11, 12 enables a sign board to be received therein and may be varied to accommodate different sized signs accordingly. The side walls 11, 12 may preferably have provided at least one aperture 17. The aperture 17 is preferably adapted to receive a securing member (not shown), such as a screw or bolt or the like, therethrough in order to secure a sign to the attachment device 1.

The side walls 11, 12 preferably have provided at least one crest portion 14. The crest portion 14 is preferably integrally formed with the side wall 11, 12 and preferably curves outwardly toward the exterior of the device 1. It is envisaged that there may be provided at least one rib 16. The rib 16 is preferably integrally formed with the Inner side wall 11 and is adapted to provide structural support and strength to the side wall to provide adequate support for the sign being held. The crest(s) 14 is/are preferably adapted to accommodate for the presence of a prong member 15 located within the space between the two side walls 11, 12.

The sign attachment device 1 preferably has provided at least one prong member 15. It Is envisaged that the number of prong members 15 provided will be dependent on the length of the body portion 10 of the device 1 and/or rigidity of the sign. In a preferred embodiment of the invention, the body portion 10 of the device 1 has provided four prong members 15. The prong members 15 are preferably located within the space provided between the two side walls 11, 12 of the body portion 10 of the device 1. The prong members 15 are preferably integrally formed with the base member 20 of the body portion 10 and are adapted to extend outwardly from the base member 20 of the body portion 10. In a preferred embodiment, it is envisaged that the prong member 15 located at the front end 16*a* and the prong member located at the back end 15*a* of the body portion are shorter in length than the two centrally located prong members 15*b*. The prong members 15 are adapted to pass through apertures provided in a flute board or coreflute sign so that edges of the sign can be received and securely held within the body portion 10 of the device 1. The short prong members 15*a*, located deeper within the body portion 10, are preferably designed to assist in securely holding the edge of a sign deep within the body portion 10 of the device 1 so that it will not detach and/or prevent lateral movement of the sign easily, particularly in extreme wind conditions. The long prong members 15*b*, which preferably extend slightly further than the top edge of the side walls 11, 12, are preferably designed to support the flex or movement of the flute board or coreflute material and act as locator pins for the insertion of the sign. In a further embodiment where a different signage material Is utilised it is envisaged that these prong members 15 may be removed from the design and/or modified to an alternate design to adequately hold and support the signage material.

The body portion 10 of the sign attachment device 1 may preferably have provided a base member 20, The base member 20 Is preferably integrally formed with the two side walls 11, 12 and adapted to be perpendicularly positioned relative to, and at the base of, the side walls 11, 12. The base member 20 preferably has provided at least one outwardly extending portion 21 which is adapted to extend perpendicularly outward from the adjacent inner side wall 11 of the body portion 10 of the device 1. In a preferred embodiment of the Invention, the base member 20 has provided two outwardly extending portions 21 which are adapted to be integrally formed with the base member 20 and/or inner side wall 11 of the body portion 10 of the device 1, A first outwardly extending portion 21 is adapted to be located at a front end of the device 1 and a second outwardly extending portion 21 is adapted to be located at a back end of the device 1. The outwardly extending members 21 are preferably adapted to abut against and support a fin or flange portion (not shown) of a star picket post or portion of a support member that is placed against the inner surface of the outwardly extending members 11. It is envisaged that the shape and dimensions of the outwardly extending portions 21 may be varied as required to suit different support members. It is envisaged that the outwardly extending portions 21 may be omitted in alternate designs of the invention, some of which are described below.

The sign attachment device 1 preferably has provided an attachment portion which is adapted to enable the device 1 to be attached to a support member, In a first aspect of the invention, the attachment portion is designed for attachment to a fin or flange of a star picket post/fence or any other suitable support member. The attachment portion 30 is preferably adapted to be integrally formed with the inner side wall 11 of the body portion 10 of the device 1. In a preferred embodiment of the invention, the attachment portion 30 preferably has provided a curved portion 31. The bottom edge 32 of the curved portion 31 is preferably adapted to be Integrally formed with the inner side wall 11 and/or base member 20 of the body portion 10 of the device 1. The curved portion 31 is preferably adapted to extend radially outward relative to the side wall 11, 12 and base members 20 respectively. The curved portion 31 is preferably positioned such that, the bottom surface 33 of the curved portion 31 is positioned slightly inward from the base 20 of the device 1 In order to provide a space between the base 20 of the device 1 and the curved portion 31 of the attachment portion 30, which is adapted to receive and hold the fin or flange of a star picket post or other portion of a support member therein.

The attachment portion 30 preferably has provided at least one reinforcement member 34. In a preferred embodiment, the attachment portion 30 preferably has provided four parallel reinforcement members 34 which are adapted to be positioned along the curved portion 31 of the attachment portion 30 and be spaced apart from each other. The reinforcement members 34 are adapted to be integrally formed with the inner surface of the curved portion 31 and the inner side wail 11 of the body portion 10 to provide reinforcement and a means of transferring any wind pressure to the support member. It is envisaged that the reinforcement member(s) 34 located centrally of the attachment portion 30 may have larger dimensions than those located at either end/side to provide greater support for the inner side wall 11 and sign to prevent excessive flex and damage in extreme weather conditions.

The curved portion 31 of the attachment portion 30 of the sign attachment device 1 preferably has provided at least one aperture 35. In a preferred embodiment of the invention, the curved portion 31 may have provided five apertures 35 which are adapted to be positioned along the curved portion 31 of the attachment portion 30 whereby, each aperture 35 may be located adjacent to, and separated by, at least one reinforcement member 34 of the attachment portion 30. The apertures 35 of the attachment portion 30 are preferably adapted to receive a securing means (not shown) therethrough in order to secure the sign attachment device 1 to a star picket post/fence or other support member. The apertures 35 are preferably positioned in relation to a corresponding hole(s) provided in the support member so that the securing means will tension the base member 20 and/or attachment portion 30 against the support member. The securing means may preferably be a cable tie or any other suitable securing/fastening mechanism.

In a second aspect of the Invention, the attachment portion 30 is preferably In the form of a bracket for attachment to a cylindrical support member and/or a support member having a corner and/or a flat support member or surface. In its bracket form for connection to a corner of a support member and/or cylindrical support member, the attachment portion 30 preferably has provided two side portions 41, 42 which are adapted to be Integrally formed with, and be positioned perpendicularly to, each other. The attachment portion 30 is preferably adapted to be Integrally formed with the base member 20 and/or inner side wall 11 of the body portion 10 of the device 1 and positioned such that a first side portion 42 extends outwardly In the opposite direction to the side walls 11, 12 of the body portion 10. The side walls may preferably have provided at least one aperture 43 which is adapted to receive a securing means, such as a screw or the like, therethrough to secure the attachment device 1 to the support member. In this example, the attachment portion 30 is adapted to be slightly longer in length than the base member 20 and side walls 11, 12. Positioned on the side portions 42, 42 adjacent either end of the base member 20 and/or side walls 11, 12 Is preferably a recessed portion 45, The recessed portion Is preferably adapted to receive a band 46 or tie or other suitable securing means for enabling the attachment portion 30 of the sign attachment device 1 to be secured about a cylindrical pole or other odd-shaped support member.

Alternatively, for connection to a flat support member or surface, the second side portion 41 may preferably be shorter in length and the first side portion 42 may preferably be adapted to be connected to the end of the second side portion 41 as opposed to the body portion 10 of the device. in this example, it is envisaged that the first side portion 42 is adapted to attach to the flat support member and/or surface and has at least one aperture 44 provided accordingly for receiving a suitable securing member therethrough, In practice, the sign attachment device 1 is secured to a support member/surface by attaching the device 1 via the attachment portion 30 and/or base member 20, and ensuring that the holes on the support member align with the apertures 43, 44 on the attachment portion 30 of the device 1. The device 1 can then be secured to the support member/surface using a plastic cable be or other suitable securing means, A sign board can then be slid onto the device 1 so that the edge of the sign Is received between the side walls 11, 12 of the body portion 10 of the device 1 with the prong members 15 being inserted into the apertures (not shown) of the flute board or coreflute sign, it is envisaged that the number of sign attachment devices 1 used to attach a particular sign, may vary depending on the size and dimensions of the sign. In an alternate embodiment, further signs may be attached to the other sides of a support member In order to create an A-frame configuration for the sign.

Figure 5:
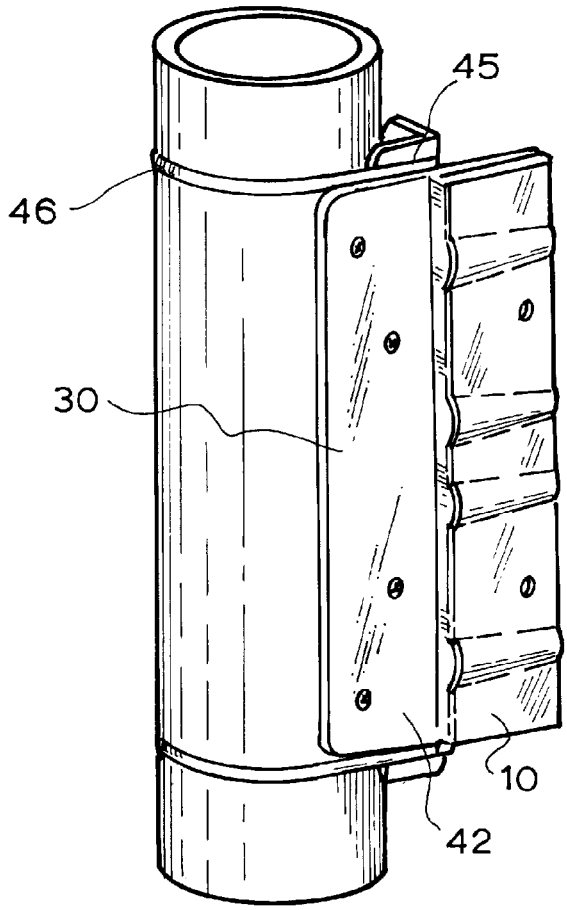
FIG. 5 shows a perspective view of the sign attachment device according to an embodiment of the invention showing the bracket form of the attachment portion for attachment to a cylindrical support member.
Figure 6:
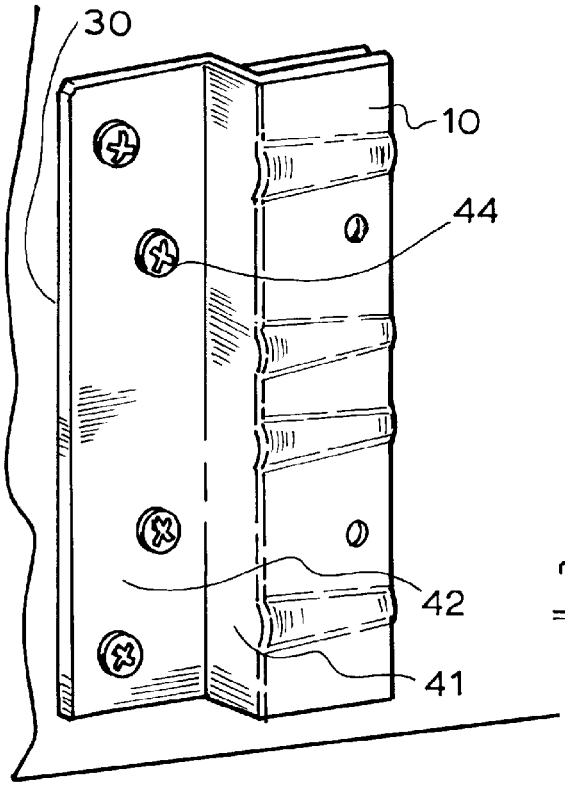
FIG. 6 shows a perspective view of the sign attachment device according to an embodiment of the invention showing the bracket form of the attachment portion for attachment to a flat surface.
Figure 7:
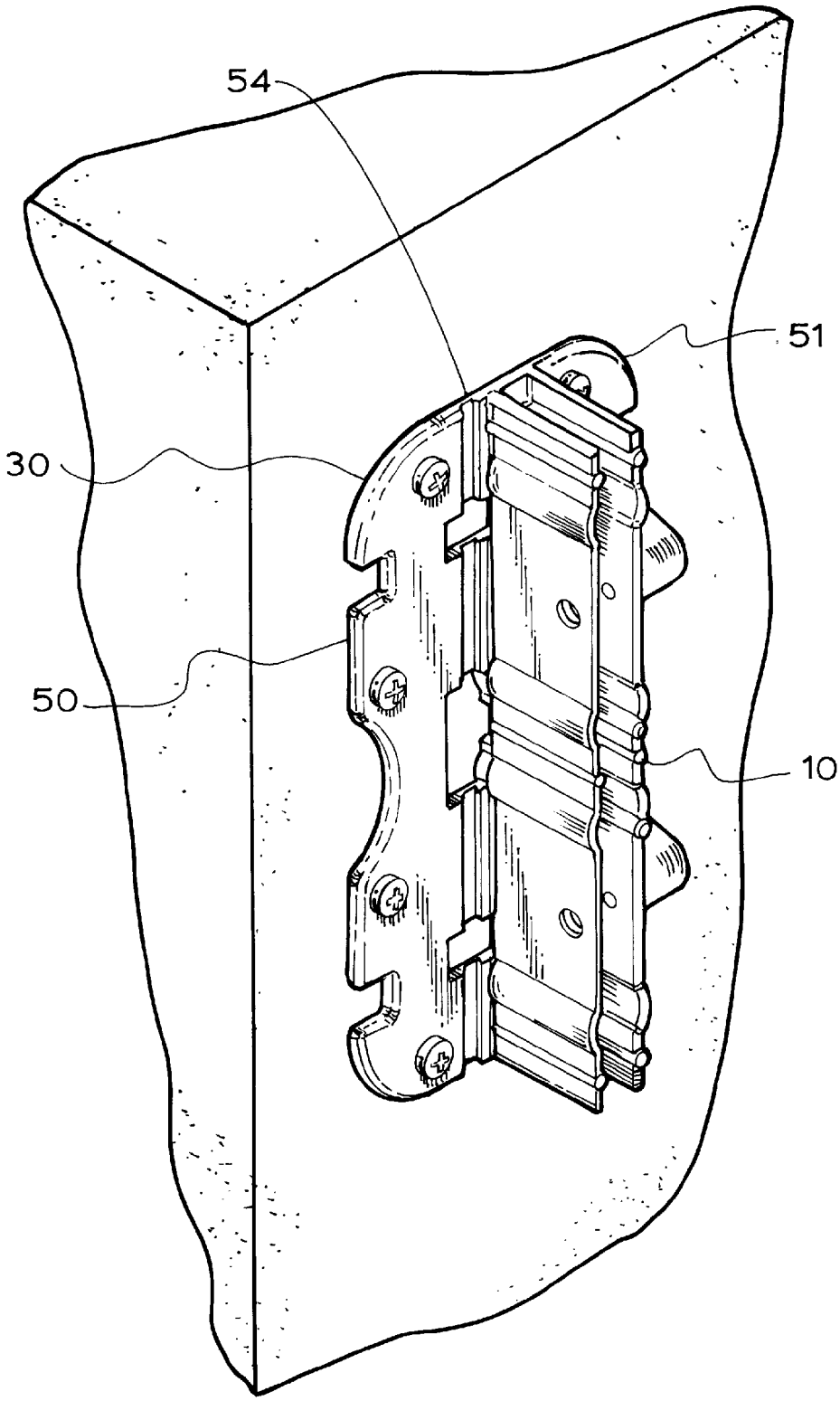
FIG. 7 shows a perspective view of a further embodiment of the invention on a flat surface.
Figure 8:
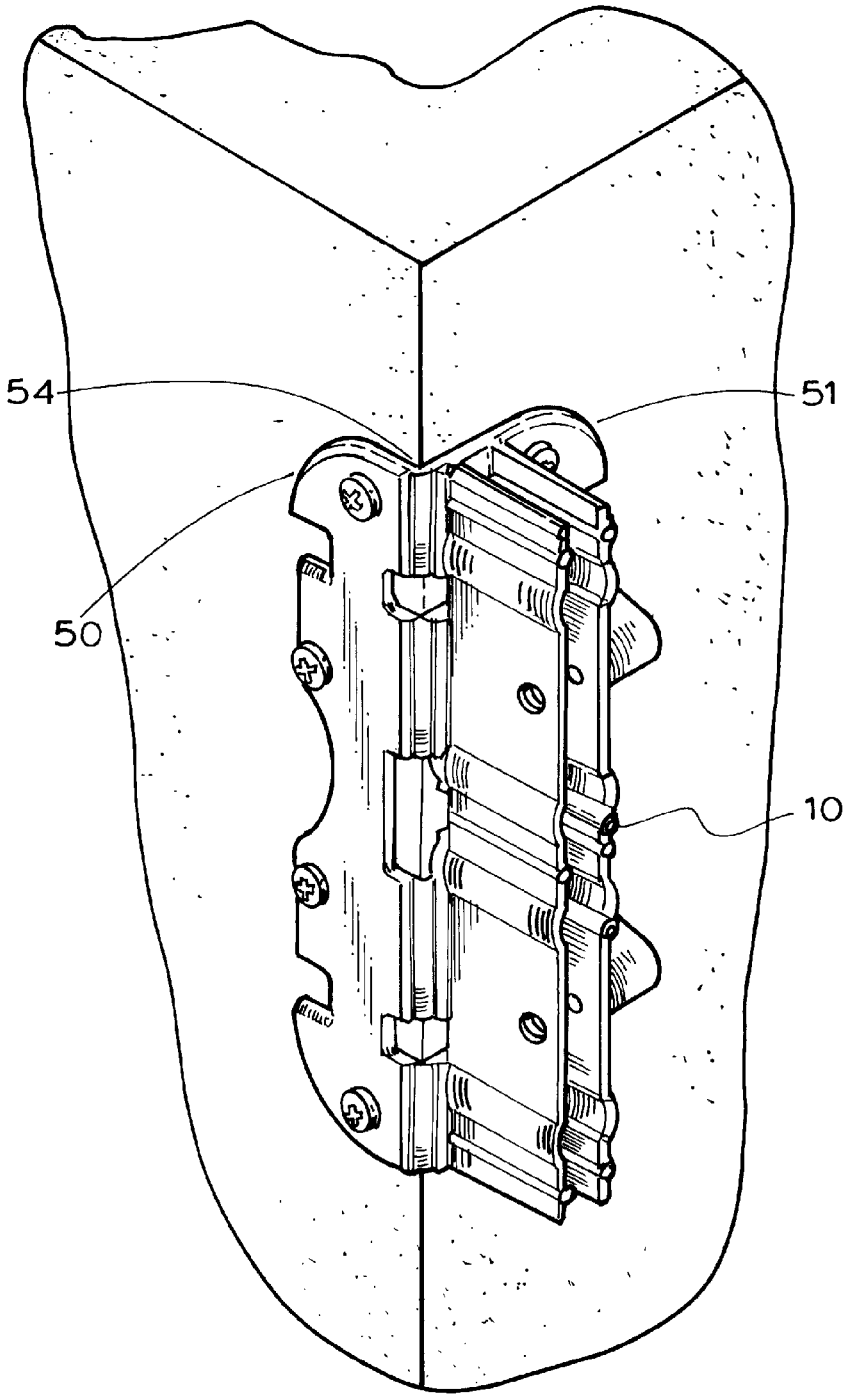
FIG. 8 shows the embodiment of FIG. 7 mounted on a corner.

In another embodiment the attachment device includes a living hinge within the attachment portion 30. As shown in FIGS. 7 and 8 the attachment portion consists of two flat flanges 50 and 51 at right angles to the body portion 10. The fold line 54 defines the living hinge that marks the border between flanges 50 and 51. As shown in FIGS. 7 and 8 this arrangement allows the same device to be used on flat surfaces and at corners of any angle. It can also be used on curved surfaces using cable ties in the same manner as shown in FIG. 5. This embodiment using a living hinge in the device means that one injection moulded integral attachment device can be used in many situations and the inventory required is reduced providing cost savings.

While we have described a particular embodiment of a sign attachment device 1, it is further envisaged that other embodiments of the invention could exhibit any number and combination of any one of the features previously described, However, It is to be understood that any variations and modifications can be made without departing from the spirit and scope thereof.

I claim:

1. A sign attachment device composed of moulded synthetic plastics material for fixing signs made of flute board to a support member including:

an integral body portion consisting of a base member projecting from which are two parallel, side walls which are adapted to be spaced apart to receive and hold the edge of a flute board there between;

at least two prong members integrally formed with the base member of the body portion and positioned between said two side walls;

the two side walls and the at least two prong members extending normally from the base member;

and an attachment portion integrally formed with said base portion for enabling the device to be attached to a support member;

and wherein the prong members are of different lengths.

2. A sign attachment device as claimed in claim 1, wherein the side walls are provided with at least one aperture which is adapted to receive a securing means there through.

3. A sign attachment device as claimed in claim 1 the attachment portion is integrally formed with a said base portion for enabling the device to be attached to a support member wherein the attachment portion is in the form of a bracket for attachment to a cylindrical support member and/or a support member having a corner and/or a flat support member or surface.

4. A sign attachment device as claimed in claim 3, wherein the attachment portion has provided at two side portions, which are integrally formed with a living hinge forming the border between the two portions so that they can be folded about the hinge to fit any support shape.

5. A sign attachment device as claimed in claim 4, wherein the side walls are provided with at least one aperture which is adapted to receive a securing means there through.

6. A sign attachment device as claimed in claim 4 wherein the attachment portion is in the form of a bracket for attachment to a cylindrical support member and/or a support member having a corner and/or a flat support member or surface; in its bracket form for connection to a corner of a support member and/or cylindrical support member, the attachment portion has provided two side portions which are adapted to be integrally formed with, and be positioned perpendicularly to, each other; the attachment portion is adapted to be integrally formed with the base member and/or inner side wall of the body portion of the device and positioned such that a first side portion extends outwardly in the opposite direction to the side walls of the body portion; the side walls have provided at least one aperture which is adapted to receive a securing means, such as a screw or the like; there through to secure the attachment device to the support member.

7. A sign attachment device as claimed in claim 3, wherein the side walls are provided with at least one aperture which is adapted to receive a securing means there through.

8. A sign attachment device as claimed in claim 3 wherein the sign attachment device has provided an attachment portion which is adapted to enable the device to be attached to a support member; wherein the attachment portion has provided a curved portion with the bottom edge of the curved portion adapted to be integrally formed with the inner side wall and/or base member of the body portion.

9. A sign attachment device as claimed in claim 8 wherein the attachment portion has provided a curved portion with the bottom edge of the curved portion adapted to be integrally formed with the inner side wall and/or base member of the body portion; the attachment portion is designed for attachment to a fin or flange of a star picket post/fence or any other suitable support member; the attachment portion is adapted to be integrally formed with the inner side wall of the body portion; the curved portion is adapted to extend radially outward relative to the side wall and base members respectively and the curved portion is positioned such that, the bottom surface of the curved portion is positioned slightly inward from the base of the device in order to provide a space between the base of the device and the curved portion of the attachment portion, which is adapted to receive and hold the fin or flange of a star picket post or other portion of a support member therein.

10. A sign attachment device as claimed in claim 8 wherein the attachment portion has provided at least one reinforcement member; the attachment portion has provided four parallel reinforcement members which are adapted to be positioned along the curved portion of the attachment portion and be spaced apart from each other; the reinforcement members are adapted to be integrally formed with the inner surface of the curved portion and the inner side wall of the body portion to provide reinforcement and a means of transferring any wind pressure to the support member.

11. A sign attachment device as claimed in claim 10 wherein the curved portion of the attachment portion of the sign attachment device has provided at least one aperture; the curved portion has provided a plurality of apertures which are adapted to be positioned along the curved portion of the attachment portion whereby, each aperture may be located adjacent to, and separated by, at least one reinforcement member of the attachment portion; the apertures of the attachment portion are adapted to receive a securing means therethrough in order to secure the sign attachment device to a star picket post/fence or other support member; the apertures are positioned in relation to a corresponding hole(s) provided in the support member so that the securing means will tension the base member and/or attachment portion against the support member.

12. A sign attachment device as claimed in claim 1, wherein the side walls are provided with at least one aperture which is adapted to receive a securing means there through.

* * * * *